US006199636B1

(12) United States Patent
Harrison

(10) Patent No.: US 6,199,636 B1
(45) Date of Patent: Mar. 13, 2001

(54) OPEN BARREL CAGE

(76) Inventor: Michael L. Harrison, 905 E. 20th St., Owensboro, KY (US) 42303

( * ) Notice: Subject to any disclaimer, the term of this patent is extended or adjusted under 35 U.S.C. 154(b) by 0 days.

(21) Appl. No.: 09/250,150

(22) Filed: Feb. 16, 1999

(51) Int. Cl.[7] ..... E21B 34/06
(52) U.S. Cl. ..... 166/328; 166/325
(58) Field of Search ..... 166/108, 327, 166/325, 328; 137/329.03

(56) References Cited

U.S. PATENT DOCUMENTS 925,510 * 6/1909 Ritchie et al. ..... 137/329.03
1,736,486 * 11/1929 Carnahan ..... 137/329.03
3,062,296 * 11/1962 Brown ..... 166/225

* cited by examiner

*Primary Examiner*—Robert E. Pezzuto
*Assistant Examiner*—Meredith C. Petravick

(57) ABSTRACT

An open type cage, having exterior threads and three equally spaced slots, which locates and contains the stationary or standing ball and seat check valve, and connects to standardized, stationary barrel, top or bottom anchored, rod insert pumps that are commonly used for crude oil production. This cage allows for the placement of a standard sized, flat type, ball and seat at the very end of the pump barrel or extension coupling, or up inside of the same. This positioning allows the upper travelling valve to sweep as close as possible to the lower standing valve when the plunger is at the bottom of its stroke. This reduces the unswept volume and increases the pumps compression ratio. This cage has two slightly different configurations that is determined by the bore size of the pump for which it is designed, but both variations use standard valve sizes and threaded connections.

6 Claims, 5 Drawing Sheets

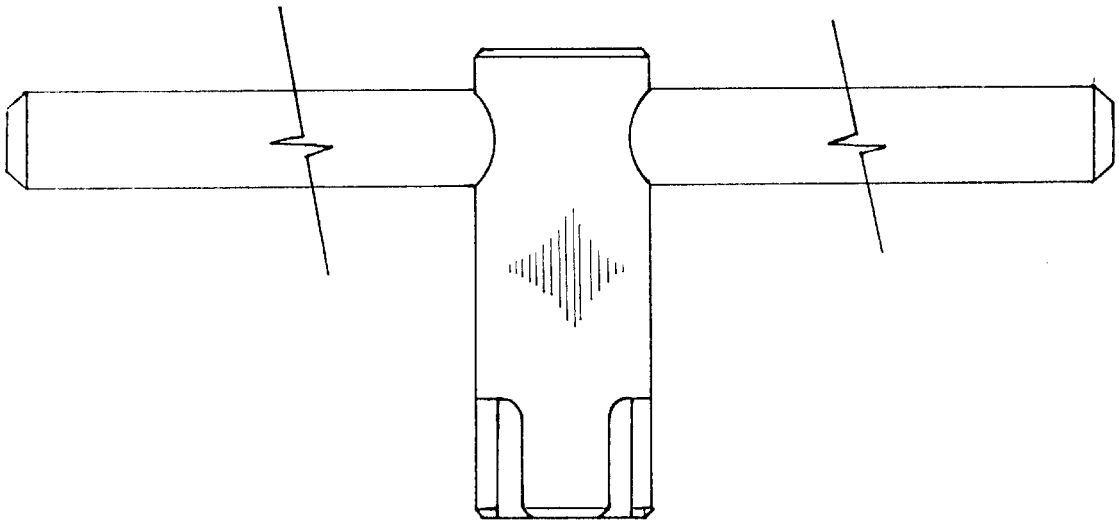
FIG. 7
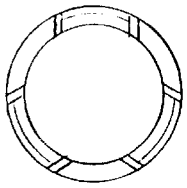

OPEN BARREL CAGE

TECHNICAL FIELD

My invention relates to subsurface, positive displacement, ball check valve actuated, cylindrical, reciprocating plunger pumps which are typically used in oil wells to produce crude oil. In particular, my invention relates to the cage which locates and contains the lower, stationary or standing ball check valve.

BACKGROUND OF THE INVENTION

The standard "closed barrel cage" as specified in American Petroleum Institute publication, *Specification* 11AX For Subsurface Sucker Rod Pumps and Fittings 9th edition, 1989 (A.P.I. Spec. 11AX), and designated as C14-15, C14-20-125, C14-20, C14-25, and C14-30, has been the only cage offered by the major pump manufacturers for use in standard, stationary barrel, top or bottom anchored, rod insert pumps (i.e.—A.P.I. Spec. 11AX pump designations: RSA, RSB, RHA, RHB, RWA, and RWB). These cages have proven to be economical, relatively free flowing, and durable under most average pumping conditions. And they have been modified, with some degree of success, to enhance durability and performance in more demanding conditions. However, closed barrel cages have some inherent design deficiencies that cause problems with pumping systems which have plagued their users for years.

The first and foremost design limitation is in how they position the lower stationary or standing ball and seat valve. All current designs of these cages are quite long, which is necessary to give the closed design adequate fluid passage, and to allow for the long, external thread on top (A.P.I. Spec. 11AX "C11" pin thread) which screws into the bottom of the pump barrel. This results in a great deal of space or unswept volume between the lower standing valve (i.e.—the suction) and the upper travelling valve (i.e.—the discharge) when they are closest together at the bottom of the plunger down-stroke. This unswept volume presents no major problem if the fluid being pumped is all or mostly all liquid because liquids are nearly incompressible. Crude oil, however, usually contains dissolved natural gas, some of which separates from the liquid when subjected to the drop in pressure caused by the up-stroke of the pump plunger. In addition, free natural gas is usually found in the formation and will inevitably gravitate to the pump suction. If enough of the swept volume of the pump is filled with gas instead of liquid, then a condition known as "gas locking" can occur. Gas lock occurs when the gas in the pumping chamber is not compressed to a sufficiently high pressure, during plunger down-stroke, to overcome the hydrostatic pressure being exerted on the top of the closed travelling valve check ball. This hydrostatic pressure is due to the weight of the fluid column above the pump inside the production tubing. This failure of the travelling valve to open prevents the pump from discharging the fluid inside the pumping chamber.

A further limitation of the closed barrel cage design is that its internal passages are more intricate and therefore more restrictive than their open cage counterparts. This is a considerable disadvantage when used in the standing (suction) valve position because the potential pressure differential is not as great as is possible in the travelling (discharge) valve position. This restrictive design also tends to aggravate any potential problem with gas locking because they are more likely to cause the dissolved natural gas to separate, much like the effect of agitating carbonated water.

Closed barrel cages also have more of a tendency to become clogged by foreign matter from the formation which can further restrict flow and cause even more undesirable gas separation.

There have been attempts to remedy some of the problems associated with closed barrel cages such as reducing the cage volume, using various types of inserts to guide and contain the ball with much less restriction to flow, and some have even modified other parts of the pump, or used mechanical devices to force the operation of the valves. However, seemingly none of the previous efforts have been in wide acceptance by the marketplace as a universal and foolproof solution to any of the before mentioned problems, especially gas lock. In fact, the closest thing to a cure for the problems associated with the use of closed barrel cages probably pre-dates their invention—the long defunct McGregor Working Barrel Pump Co. of Bradford, Pa. produced a 1⅝" bore, stationary, rod pump which had a seating mandrel which screwed into the bottom of the pump barrel tube, and just above the barrel threads on the mandrel was another threaded section, smaller in diameter, which screwed onto an open type cage (similar to A.P.I. Spec. 11AX designation C17-150) which contained a "rib type" ball and seat check valve. This design placed the standing valve up inside the barrel about two or three inches (instead of two inches below the barrel like a closed barrel cage does) and yielded a very small unswept volume with a very high compression ratio. The drawbacks were that the travelling valve was placed on top of the plunger instead of below it, and that the pump required many special "McGregor only" parts rather than A.P.I. types which caused its eventual demise.

SUMMARY OF THE INVENTION

The "open barrel cage" is of one basic design with two somewhat different variations. This is necessary due to the constraints of inventing a cage that is a direct replacement (i.e.—using A.P.I. standard parts and threaded connections) for the closed barrel cage in five different sizes, but without its inherent limitations. The "small bore" version of the open barrel cage is a direct replacement for A.P.I. Spec 11AX closed barrel cage designations C14-15 and C14-20. There is also an open barrel cage to replace C14-20-125, but requires a change from the standard 1⅛" check ball to a smaller 1" diameter ball. The "large bore" version of the open barrel cage is a direct replacement for the C14-25 and C14-30 cages, and there is also a "McGregor" version of this cage.

The open barrel cage designed for small bore pumps consist of a cylindrical section that is about one-third of the overall length of the cage and has the same outer diameter as that of the barrel which it screws into, except for the one that replaces C14-20-125, which is slightly larger than the barrel. This is followed by a smaller, exteriorally threaded section, equal to about another one-third of the overall length, which screws into the barrel tube. The remaining cylindrical section is of a smaller diameter than the threaded section and is closed on the top. Three equally spaced (radially) slots are cut longitudinally from the top section and extend down about two-thirds of the way into the threaded section. Inside, these cages have a large, cylindrical, inner diameter that is open on the bottom of the large, cylindrical, outer diameter section, and is about 3/16" shorter than the same large, outer diameters length. The large, inner diameter is threaded for about two-thirds of its length and accepts a standard sized, A.P.I., flat type ball and seat, and the seating mandrel threads on bottom anchored pumps, or the ball and seat and the barrel cage seat bushing threads on top anchored pumps. A smaller, cylindrical, inner diameter section extends from the large inner diameter and passes into the exteriorally threaded section and the smaller top section, but does not go through. This small, inner diameter forms the ball chamber, and the slots are machined through this section which allows for fluid passage.

Likewise, the open barrel cage for large bore pumps has a very short, cylindrical section that has the same outer diameter as that of the pump barrel tube to which it assembles. Next comes an exteriorally threaded section of smaller diameter, which in conjunction with the previous section, is equal to approximately one-half of the cages overall length. This threaded section screws into the bottom of the pump barrel tube. Finally, there is a smaller diameter section, slightly longer than the total of the other two, which is closed on the end. It also has three equally spaced, longitudinally cut slots that extend down to the threaded section, but, unlike the small bore cages, are not cut into it. Inside is the large, threaded, cylindrical inner diameter of the proper size and depth to accept a standard sized, A.P.I., flat type, ball and seat with the seating mandrel or barrel cage seat bushing, depending on the anchor position. And, as with the small bore cages, a smaller, cylindrical, inner diameter extends from the large inner diameter and passes into the small outer diameter section, but does not go through the end, thus forming the ball chamber. The slots are also machined through this chamber to allow fluid passage.

The object of my invention is as follows:

1) To allow the placement of the (lower) standing ball and seat check valve up inside of the pump barrel tube or extension coupling, or to place it as close as possible or practical to the end of the same on A.P.I. Spec. 11AX stationary, rod insert pumps.
2) To produce a direct replacement cage for A.P.I. Spec. 11AX closed barrel cages that accept standard flat type ball and seat valves of the same size, and their standard, threaded connections.
3) To incorporate an "open type" cage, with all of its inherent advantages (i.e.—less restriction and more flow, less prone to clogging, and greater durability), in the barrel cage position on stationary pumps.
4) To eliminate as much of the pumps unswept volume as is possible or practical in order to produce the highest possible compression ratio.
5) To reduce the likelihood of, or eliminate altogether the occurence of a condition known as "gas locking", and to measurably increase pump efficiency.

These and other objects, features and advantages of my invention will become readily apparent, to those skilled in this field, from the following detailed description and attached drawings, of which the preferred embodiments of my invention are illustrated.

BRIEF DESCRIPTION OF THE DRAWINGS

FIG. 3 is shown with the standard closed barrel cage 55, while FIG. 4 has in its place the novel open barrel cage 40 for large bore pumps.

FIG. 5 is shown with the standard closed barrel cage 56, while FIG. 6 has in its place the novel open barrel cage 50 for small bore pumps.

FIG. 7 shows the novel three-prong wrench used for the installation and removal of the open barrel cage for large bore pumps.

DETAILED DESCRIPTION OF THE PREFERRED EMBODIMENT

Figure 1:
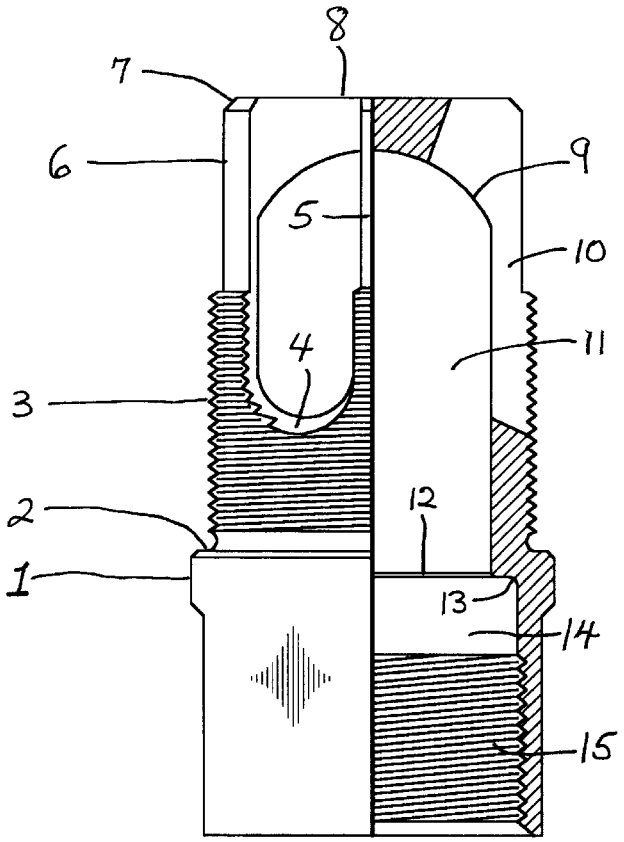
FIG. 1 shows a one-quarter sectional view of the preferred embodiment of the invention for small bore pump.
Figure 8:
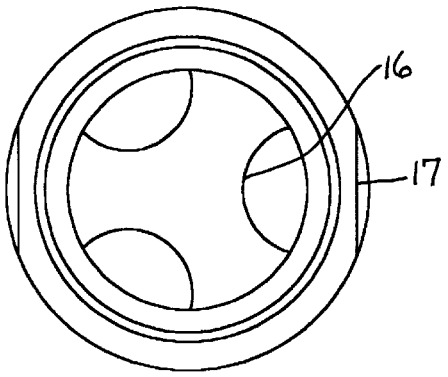
FIG. 8 shows a corresponding bottom end view of FIG. 1.
Figure 2:
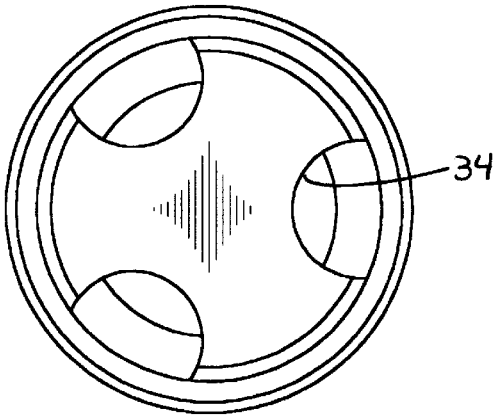
FIG. 2 shows a top end view of the preferred embodiment of my invention for large bore pumps.
Figure 9:
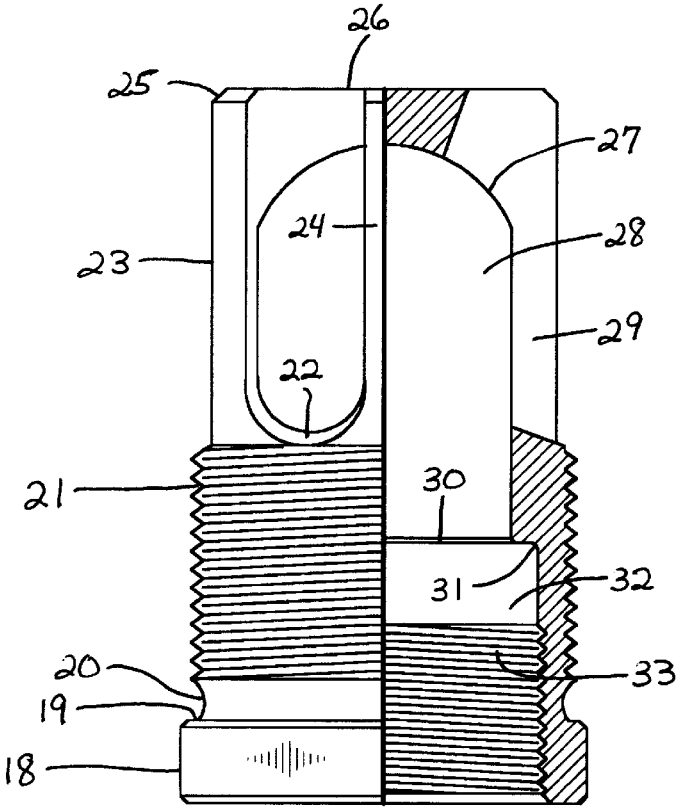
FIG. 9 shows a one-quarter sectional view of the preferred embodiment of my invention for large bore pumps.

FIGS. 1 & 2 show the preferred embodiments of my invention, the open barrel cage, which is used to position and contain the lower ball and seat valve in stationary barrel, rod insert, subsurface pumps commonly used for crude oil production. My invention is a one piece unit, machined from a suitable metal alloy such as 1045 or 4140 steel, 464 tin-brass, 316 stainless steel, or 405 Monel (a nickel-copper alloy made by INCO Metals Co.), with the material being determined by the operating conditions in the well.

Figure 6:
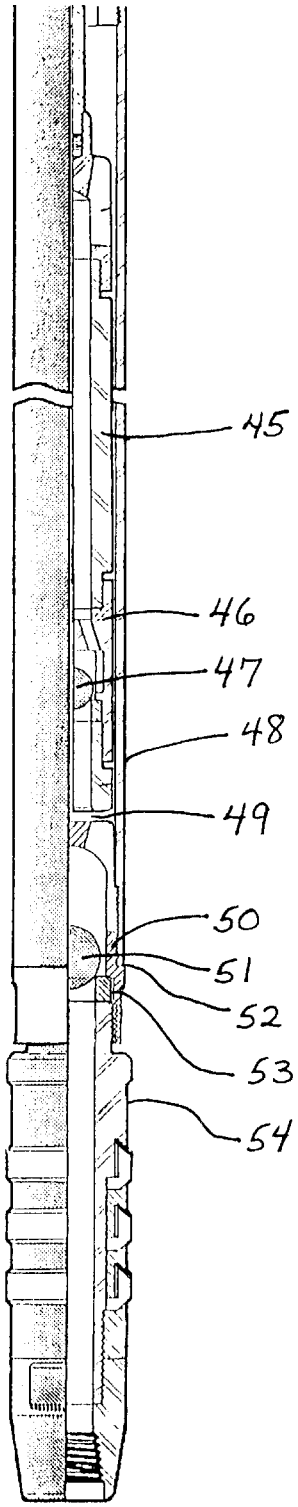

The FIG. 1 embodiment is specifically designed for small bore pumps where there is insufficient material for the exterior 3 and interior 15 threads to coincide on a horizontal plane. The largest outer diameter 1 will be no larger than the pump barrel tube 48 (see FIG. 6) or extension coupling (on RHA & RHB pumps) it screws into, and the top of this diameter forms the square shoulder 2 which provides a suitable surface for the end of the barrel tube to seal against. Above this outer diameter 1 is a smaller diameter 3 which has exteriorally cut screw threads that are of the proper form, length, pitch and pitch diameter to provide a means by which to connect the invention to the barrel tube. These thread specifications are governed by A.P.I. Spec. 11AX thread table "C". Above the threaded diameter 3 is a slightly smaller outer diameter 6 which must be smaller than the inner diameter of the pump barrel tube. This diameter terminates in a closed, perpendicular fashion 8 and has a slight 45° bevel 7 around the top to ease installation.

Going down the right-hand side of FIG. 1 we see the cut-away view of the ball chamber inner diameter 11 which terminates at the top in a radius 9. The inner diameter of the ball chamber is large enough to accommodate the free reciprocating action of a standard sized A.P.I. Spec. 11AX designation "V11" check ball (with the exception of the C14-20-125 replacement cage) without allowing a great amount of lateral movement of the same. The top radius 9 is purposely larger than the radius of the ball chamber inner diameter 11 by a factor of approximately 1.1 to 1. This tends to cushion the impact of the check ball 51 (see FIG. 6) during operation; this effect is due to the convex surface of the ball is impacting the concave surface of the ball chambers top radius 9. This radius also centers the ball for its drop back on to the seat 53 (see FIG. 6) during closing. Finally, the top radius 9 is larger than that of the ball chamber, and consequently, that of the ball itself, so that higher viscosity crude oils will not cause the ball to stick open.

Next we see the cut-away view of my inventions three cage openings or slots 10. These slots, which are open from the ball chamber 11, and pass through the exteriorally threaded diameter 3, and the small outer diameter 6, allows for fluid to go from the ball chamber, through the cage 50, and into the pumping chamber 49 of the pump (see FIG. 6). From this we derive the term "open cage". These slots are radially spaced 120° apart, and are cut longitudinally from the closed end 8 of the small outer diameter 6, at a 20° angle to the axis of the cage which results in slots that are of the required width and of increasing depth. These slots, when viewed from the top of the cage, (see FIG. 2, #34 for an example) form a floor with a full radius 16; this shape gives smooth flow and gives the cage more structural integrity. These slots 10 extend down approximately two-thirds of the way into the exteriorally threaded diameter 3 where they terminate with the same sized radius 4 as that of the slots floor 16.

At the beginning of the ball chamber inner diameter 11 is the larger counterbored inner diameter 14 which functions as a circular space for the disk shaped valve seat 53 (see FIG. 6) to locate and seal, and to also serve as the minor diameter of the interior threads 15. The size, depth and tolerances of this counterbored step and its interior threads are determined by the ball and seat size, and are specified by A.P.I. Spec. 11AX thread table "F". This counterbored inner diameter 14 terminates at the top in a perpendicular fashion which leaves a flat face 12 with a specified corner radius 13.

From the point of the counterbores termination 12, to the top radius 9 establishes the check balls 51 (see FIG. 6) length of travel in the ball chamber 11. This length is determined by taking the diameter of the check ball for which the cage is designed, and multiplying it by a factor of approximately 1.8. This is demonstrated to permit adequate flow while minimizing ball travel and the associated wear on the ball and its guides 5, which are the solid ribs between the cage slots that "cage" or keep the ball in place.

Figure 3:
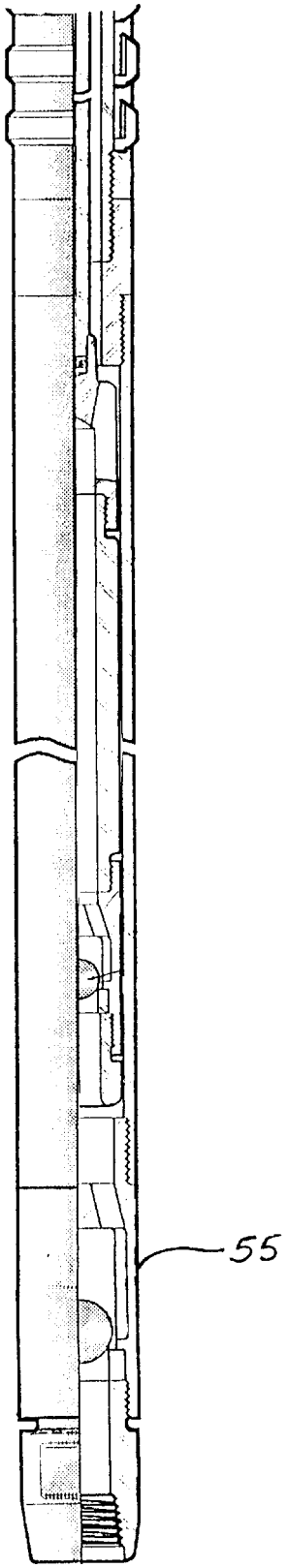
FIGS. 3 & 4 show a side by side one-quarter sectional view of the lower portion of two standard A.P.I. Spec. 11AX large bore (i.e.—2" or 2½" bore) RWAC rod, stationary, thin walled barrel, top anchored pumps, with their plungers at the lowest part of the stroke.

The interior threads 15 not only retain the check ball 51 and the valve seat 53 (see FIG. 6) by means of another threaded member, but they also serve as a means to connect the upper parts of the pump assembly to its inlet provisions: either a seating assembly 54 (see FIGS. 5 & 6) in the case of bottom anchored pumps, or a containing and connecting device 44 (see FIGS. 3 & 4) in the case of top anchored pumps.

This preferred embodiment of my invention for small bore pumps also includes the optional wrench flats 17 which are cut opposite of each other and extend from the bottom of the large outer diameter 1 up, and end at about three-fourths of its length.

A principal and novel feature of my invention regards the set distance between the seal surface 2 for the barrel tube, and the seat surface 12 for the valve seat. This length is to be held, ideally, to about ⅛" which allows the standing valve seat 53 (see FIG. 6 and compare with FIG. 5) to be located as close to the end of the barrel tube 52 as is possible or practical, thus minimizing the unswept volume between the standing valve seat 53 in the open barrel cage 50, and the travelling ball and seat valve 47 in its cage 46 attached to the end of the plunger 45.

FIG. 2 shows the preferred embodiment of my invention for large bore pumps, where there is sufficient material to allow the exterior 21 and interior 33 threads to coincide on a horizontal plane. At the bottom left-hand side of FIG. 2 we see the large outer diameter 18 which is no larger than the outer diameter of the pump barrel tube 38 (see FIG. 4) or extension coupling (RH pumps only) that it screws into. The length of this diameter is only enough to provide sufficient strength for the flat shoulder 19 which is formed by a combination of the smaller outside diameter of the exteriorally threaded section 21 and the thread relief undercut 20. This provides a suitable surface for the end of the pump barrel tube 43 (see FIG. 4) to seal against.

Figure 4:
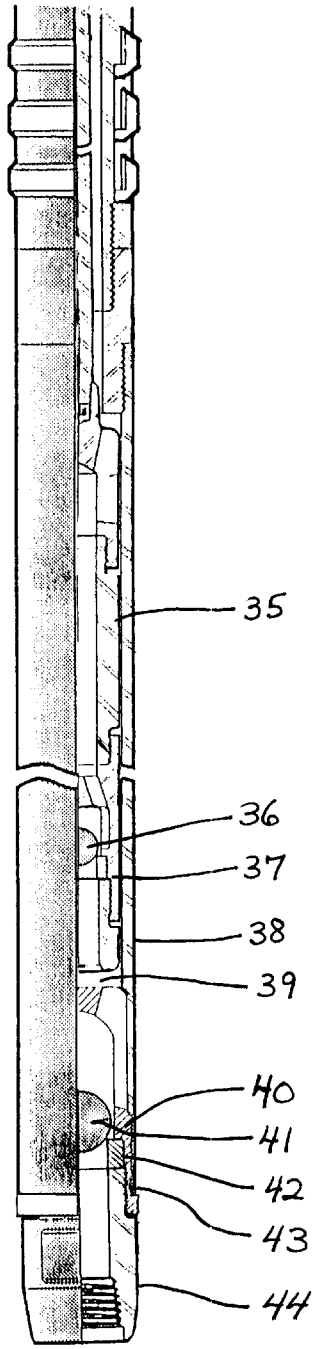
Figure 5:
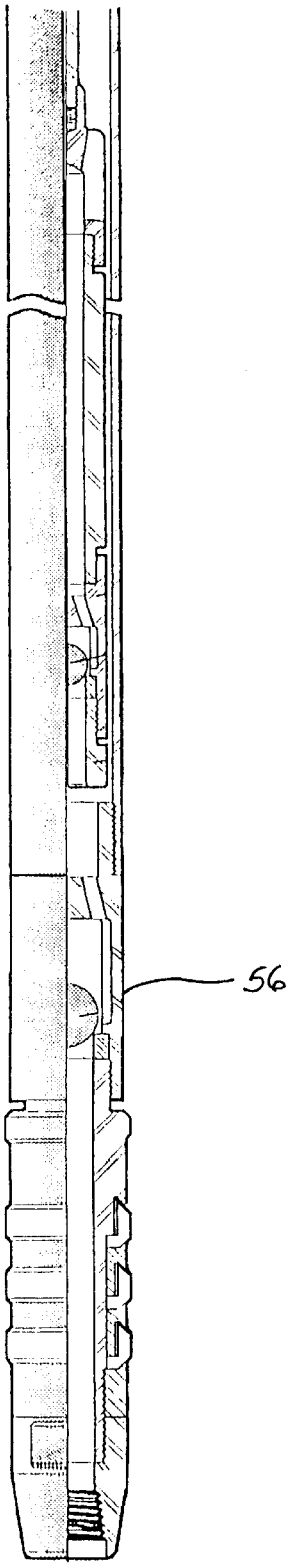
FIGS. 5 & 6 show a side by side, one-quarter sectional view of the lower portion of two standard A.P.I. Spec. 11AX small bore (i.e.—1¼" or 1½" bore) RWBC rod, stationary, thin walled barrel, bottom anchored pumps, with their plungers at the lowest part of the stroke.

The exterior screw threads 21 are of the proper form, length, pitch and pitch diameter to provide a means by which to connect my invention to the pump barrel tube 38 (see FIG. 4). The thread specifications are governed by A.P.I. Spec. 11AX thread table "C", with the exception of the "McGregor" cage, which has a 1.750-12 NS thread form.

Above the threaded diameter 21 is a smaller outer diameter section 23, slightly smaller than the barrel tubes inner diameter, and terminates on top 26 in a closed, perpendicular fashion, and includes a slight 45° bevel 25 to ease installation.

Continuing with FIG. 2, and going down the right-hand side from the top, we see the cut-away view of the ball chambers inner diameter 28 which terminates with a top radius 27. The ball chamber is large enough to accommodate the free reciprocation of a standard sized A.P.I. Spec. 11AX check ball 41 (see FIG. 4) without allowing a great amount of lateral movement of the same. The top radius 27 is purposely larger than the ball chamber radius by a factor of about 1.1 to 1. As with the FIG. 1 embodiment, this tends to cushion the ball impact, center the ball for its drop back on to the seat, and prevent highly viscous crude oil from sticking the ball open.

Further down we see one of my inventions three cage openings or slots 29, which are open from the ball chamber 28 and through the small outer diameter 23, which allows fluid to pass through the cage 40 and into the pumping chamber 39 (see FIG. 4). This feature distinguishes my invention as a true "open cage". Couple this with the novel exterior "barrel threads" 21, and we arrive at the full title of my invention: OPEN BARREL CAGE. The three slots 29 are spaced, radially, 120° apart and are cut into the cage longitudinally, and at a 20° angle to the parts axis. This creates slots of the proper width and of increasing depth as they proceed from the top of the cage 26 to their termination point 22. When viewed from the top, the slots form a full floor radius 34 (see FIG. 2 end view) to provide smooth flow and adequate strength. These slots 29 extend from the top of the cage down to, but not touching, the exterior threads 21, and terminate with the same radius 22 as that of the floor 34.

At the beginning of the ball chamber inner diameter 28 is a larger counterbored diameter 32 which provides a circular space in which to locate the valve seat 42 (see FIG. 4), and serves as the minor diameter of the interior threads 33, just as in the FIG. 1 embodiment. And likewise, the size, depth, and tolerances of the counterbored step and its interior threads are determined by the valve size, and the specifications set forth in A.P.I. Spec 11AX thread table "F". This counterbored inner diameter 32 terminates at the top in a perpendicular fashion, leaving a flat face 30 and having a specified corner radius 31.

From the counterbores termination point 30, to that of the ball chamber 27 determines the check balls length of travel and is ascertained by the same means and for the same purposes as the FIG. 1 embodiment.

The interior threads 33 provide a means to secure the check ball 41 and the valve seat disk 42 (see FIG. 4) in the cage 40, as well as connect the upper parts of the pump to its inlet provisions, in the same manner as the FIG. 1 embodiment.

Since this particular embodiment of my invention has no exterior surfaces of sufficient length to incorporate Wrench flats for installation and removal from the barrel tube, the novel three-prong wrench of FIG. 7 was contrived for this purpose. With the ball and seat valve removed, the wrench is inserted into the ball chamber 28 (see FIG. 2), and the three equally spaced prongs, being of the proper length and width, are engaged with the cage slots 29 and provide a positive means of applying torque to the cage guides 24.

A principal and novel feature of this embodiment of my invention is that of the relationship between the flat face 30 which locates the valve seat 42 (see FIG. 4) and the flat shoulder 19 which establishes the cages 40 location to the end of the barrel tube 43 (see FIG. 4). This relationship allows for the actual placement of the standing valve up inside of the barrel tube 38 and thereby minimizes the unswept volume between the standing valve in the open barrel cage 40, and the travelling ball and seat check valve 36 in its cage 37 attached to the end of the plunger 35 (see FIG. 4).

My invention has been illustrated and described as to the preferred embodiments thereof, and discloses said invention in the best mode of operation known to the inventor. However, it is not intended that this patent should be limited, both in scope and coverage, by such details other than as specifically set forth by the following claims.

I claim:

1. A cylindrically shaped, one piece, metal cage device comprising:

a) a cylindrically shaped lower-exterior section, the length of which is defined by the interior placement of a valve seat disk in relation to a valve size and pumb bore size for which it is designed;

b) a cylindrically shaped middle-exterior section that is exteriorly threaded and is concentric with the lower-exterior section;

c) a cylindrically shaped upper-exterior section which is concentric with the exteriorally-threaded-middle section and terminates at a flat-perpendicular-closed end with a 45 degree bevel;

d) a lower-cylindrical-interior section that is concentric with the lower-cylindrically-shaped-exterior section and being open to the bottom of the same, terminates in a corner radius that is interiorly threaded from the bottom end and extending approximately three-fourths of the length of an inside diameter;

e) a smaller-upper-cylindrical-interior section that is concentric with and, proceeds from the termination of the lower-cylindrical-interior section, and concludes axially in a concave radius that is approximately 1.1 time the radius of said inner diameter;

f) three exterior slots which are equally spaced around the circumference of the upper-cylindrically-shaped-exterior section, and extend axially down from the top of the upper-cylindrically-shaped-exterior section;

g) said slots are of a chordal width that is approximately equal to one-eight of the circumference of the upper-cylindrically-shaped-exterior section and they end by forming a radius that is equal to one-half their width;

h) said slots are further described as having a radial depth at the top of the upper-cylindrically-shaped-exterior section, that is approximately equal to one-fourth of the diameter of said upper-cylindrically-shaped-exterior section, and proceeds on a line that intersects a part axis at a 20 degree angle, while defining a bottom radius that is one-half the width of said slots.

2. A cylindrically shaped one piece metal cage device as in claim 1, wherein the slots terminate approximately two-thirds of the way into the length of the exteriorly-threaded-middle section and define three open passageways from the upper-cylindrical-interior section through the upper-cylindrically-shaped exterior and exteriorly-threaded-middle section when designed for small bore pumps.

3. A cylindrically shaped one piece metal cage device as in claim 1, wherein the slots terminate before said exteriorly-threaded-middle section begins and define three open passageways from the upper-cylindrical-interior section through upper-cylindrical-exterior section only when designed for large bore pumps.

4. A cylindrically shaped one piece metal cage device as in claim 1, further including two opposed-exterior-flat surfaces that are parallel with the axis, and extend from the bottom of the cage approximately three-fourths of the length of the lower-cylindrically-shaped-exterior section to serve as wrench flats when designed for small bore pumps.

5. A cylindrically shaped one piece metal cage device as in claim 2, further including two opposed-exterior-flat surfaces that are parallel with the axis, and extend from the bottom of the cage approximately three-fourths of the length of the lower-cylindrically-shaped-exterior section to serve as wrench flats when designed for small bore pumps.

6. A cage device in accordance with claim 1 which has passageways that proceed from a containment cavity for ball check values and are opened up directly below a area swept by the pump plunger which defines said cage as being a true open type.

* * * * *